US006443705B1

(12) United States Patent
Munoz

(10) Patent No.: US 6,443,705 B1
(45) Date of Patent: Sep. 3, 2002

(54) DIRECT DRIVE VARIABLE DISPLACEMENT PUMP

(75) Inventor: Jose Munoz, Brighton, MI (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/723,588

(22) Filed: Nov. 28, 2000

(51) Int. Cl.[7] ..... F04B 1/26
(52) U.S. Cl. ..... 417/222.1; 417/269; 92/71
(58) Field of Search ..... 417/222.1, 269; 92/71

(56) References Cited

U.S. PATENT DOCUMENTS

| | | | | | |
|---|---|---|---|---|---|
| 3,099,218 | A | | 7/1963 | Budzich | 103/37 |
| 3,575,534 | A | | 4/1971 | Leduc | 417/218 |
| 3,784,328 | A | * | 1/1974 | Pedersen | 417/222 |
| 4,174,191 | A | | 11/1979 | Roberts | 417/222 |
| 4,212,596 | A | * | 7/1980 | Ruseff | 417/216 |
| 4,406,599 | A | | 9/1983 | Stephan | 418/22 |
| 4,492,540 | A | | 1/1985 | Yamamoto | 418/23 |
| 5,079,996 | A | | 1/1992 | Abousabha et al. | 92/12.2 |
| 5,222,870 | A | * | 6/1993 | Budzich | 417/222.1 |
| 5,251,537 | A | * | 10/1993 | Hoshino et al. | 91/506 |
| 5,975,858 | A | | 11/1999 | Shimotomai | 417/222.1 |
| 6,033,188 | A | * | 3/2000 | Baldus et al. | 417/222.1 |
| 6,176,684 | B1 | * | 1/2001 | Zimmermann | 417/222.1 |
| 6,179,571 | B1 | * | 1/2001 | Kawachi et al. | 417/222.1 |

FOREIGN PATENT DOCUMENTS

| | | | |
|---|---|---|---|
| FR | 1221317 | 6/1960 | |
| JP | 59077086 | 5/1984 | F04B/1/20 |
| JP | 361153054 A * | 7/1986 | |

OTHER PUBLICATIONS

Bosch Manual 571104, 1987, Robert Bosch Corporation, Radial Piston Pumps.*

Type HS–3 Horizontal Triplex Plunger Pump, Ingersoll–Rand Company Standard Pump—Aldrich Division, Allentown, PA—1 page.

(List continued on next page.)

*Primary Examiner*—Charles G. Freay
*Assistant Examiner*—Han L Liu

(57) ABSTRACT

Direct drive variable displacement pumps that provide variable displacement wherein a swashplate pivots and changes the angle position in the direct drive variable displacement pumps. The swashplate is also capable of changing the stroke length of pistons in such direct drive variable displacement pumps and rotation of a rotating shaft is converted into axial or radial movement. In direct drive variable displacement pumps in accordance with the present invention, plungers and their respective plunger housings do not rotate relative to the rotating shaft while the swashplate rotates with rotating shaft. In addition, hydraulic control pistons are preferably used to change the angle of the swashplate and these hydraulic control pistons rotate with the rotating shaft. A first preferred embodiment of a direct drive variable displacement pump disclosed herein is an axial displacement type direct drive variable displacement pump while a second preferred embodiment of a direct drive variable displacement pump disclosed herein is a radial type direct drive variable displacement pump.

21 Claims, 5 Drawing Sheets

OTHER PUBLICATIONS

VH Series Pumps, General Pump Incorporated Brochure, No. 300704, 4–94—4 pages.
VH Series of High Pressure Plunger Pump, Owner's Manual, General Pumps Incorporated—14 pages.
Variable Displacement Pump A10VO, Mannesmann Rexroth Brochure RA 92 701/3.92—25 pages.
40° Motors, ©Copyright 1983 Sundstrand Corporation—4 pages.
Axial Piston Pumps, Series PV6..PV29 Design C, Denison Hydraulics Publ. 1–AM009 4–94—4 pages.
Denison Axial Piston Series 6 & 7,Bulletin 1107–Q(Revised 9/84) 7 pages.
Denison Series PV Open Loop Axial Piston Pumps, Bulletin 1109–B, (Printed 4/84)—2 pages.
Denison Hydraulic Pumps and Motors, Axial Piston Series 46, Bulletin 1103–K—5 pages.
Sundstrand Heavy Duty Variable Displacement Pump Open Circuit Controls, A–13.00, 1–0154, Sep. 10, 1976—11 pages.
The New Generation of High–Pressure Water Systems, Wasser–Hochdruck, May 1999—2 pages.
The Products by Flow Europe—1 page.
Butterworth Jetting Systems, Inc., Winter 1998, vol. 15—2 pages.
High and Ultra High Pressure Pumps, ©Copyright of Paul Hammelmann Maschinenfabrik GmbH, Oelde, Germany, Din EN ISO 9001, 09 100 6463 8 pages.
P2040 Equipment Specs, Omax JetMachining®Center–P2040 Pump–3 pgs.
High Pressure Guide Cat Pumps—4 pages.
Geoquip Model LC 250 Plunger Pump, Fort Worth, Texas—2 pages.
Racine Bosch Group SV Pump Controls, A–11, Nov. 1986–4 pages.
Bosch Radial Piston Pumps, ©1987 Robert Bosch Corp.—12 pages.
Paper—Advances in Direct–Drive Pump Technology Brings the Competitive Edge Back to Ultrahigh–Pressure Waterjets, 7th American Water Jet Conference, Aug. 28–31, 1993, Seattle, Washington, Terry D. Alkire, Flow International Corporation 13 pages.
Paper—A Pulsation–Free Fluid Pressure Intensifier, 9th American Waterjet Conference, Aug. 23–26, 1997, Dearborn, Michigan, Gene G. Yie, Jetec Company—8 pages.
Copy of PCT International Search Report mailed Apr. 12, 2002, 7 Pages.

* cited by examiner

DIRECT DRIVE VARIABLE DISPLACEMENT PUMP

BACKGROUND AND SUMMARY OF THE INVENTION

The present invention relates generally to new and novel improvements in direct drive variable displacement pumps. More particularly, the present invention relates to direct drive variable displacement pumps that are capable of providing high pressure fluid flow for use in high-pressure fluid cutting, abrasive-fluid cutting, cleaning and similar applications.

In the past, to induce high pressure on fluids, such as above 15,000 pounds per square inch, intensifier pumps have typically been used. Intensifier pumps provide the capability of multiplying a relatively low pressure fluid, using area ratios, into a relatively high pressure fluid. Intensifier pumps are sometimes capable of providing a fluid pressure increase on the order of several magnitudes and presently some intensifier pumps are providing fluid pressures as high as 200,000 pounds per square inch.

For high-pressure fluid cutting, abrasive-fluid cutting, cleaning and similar applications, intensifier pumps capable of providing a fluid pressure on the order of 60,000 pounds per square inch are commonly used. Traditional crank type pumps are currently capable of providing a fluid pressure on the order of 40,000 pounds per square inch and are expected to be capable of providing a fluid pressure on the order of 55,000 pounds per square inch or higher in the not to distant future. Such high-pressure crank pumps are generally less complex, smaller, more efficient, less expensive, provide a higher fluid delivery to size ratio, and provide a more constant flow delivery than comparable intensifier pumps.

However, traditional high-pressure crank pumps also have their limitations. One significant limitation is that in fluid jet applications, traditional high-pressure crank pumps generally have a fixed displacement that requires either speed regulation to control the fluid flow delivery or some other way of unloading excess fluid flow, such as by using unloaders, relief valves and similar devices. This limitation is not present in intensifier pumps that provide only the necessary flow demand while maintaining the required pressure.

Accordingly, an object of the present invention is to provide direct drive variable displacement pumps that provide many of the advantages of traditional crank type pumps and intensifier pumps while eliminating many of their limitations.

Another object of the present invention is the provision of direct drive variable displacement pumps that are suitable for use in fluid cutting, abrasive-fluid cutting, cleaning, and similar application.

Yet another object of the present invention is the provision of direct drive variable displacement pumps that are capable of being used with non-lubricating fluids, such as water.

Yet another further object of the present invention is the provision of direct drive variable displacement pumps that are capable of providing constant fluid pressure, constant fluid flow, and constant horsepower.

These and other objects of the present invention are attained by direct drive variable displacement pumps that provide variable displacement wherein a swashplate pivots and changes the angle position in the direct drive variable displacement pumps. The swashplate is also capable of changing the stroke length of pistons in such direct drive variable displacement pumps and rotation of a rotating shaft is converted into axial or radial movement. In direct drive variable displacement pumps in accordance with the present invention, plungers and their respective plunger housings do not rotate relative to the rotating shaft while the swashplate rotates with the rotating shaft. In addition, hydraulic control pistons are preferably used to change the angle of the swashplate and these hydraulic control pistons rotate with the rotating shaft. A first preferred embodiment of a direct drive variable displacement pump disclosed herein is an axial displacement type direct drive variable displacement pump while a second preferred embodiment of a direct drive variable displacement pump disclosed herein is a radial type direct drive variable displacement pump.

Other advantages and novel features of the present invention will become apparent in the following detailed description of the invention when considered in conjunction with the accompanying drawings.

BRIEF DESCRIPTION OF THE DRAWINGS

FIG. 2 includes exploded elevational side views of a direct drive variable displacement pump in accordance with a first preferred embodiment of the present invention including FIGS. 2A, 2B and 2C wherein

DETAILED DESCRIPTION OF THE DRAWINGS

Figure 1:
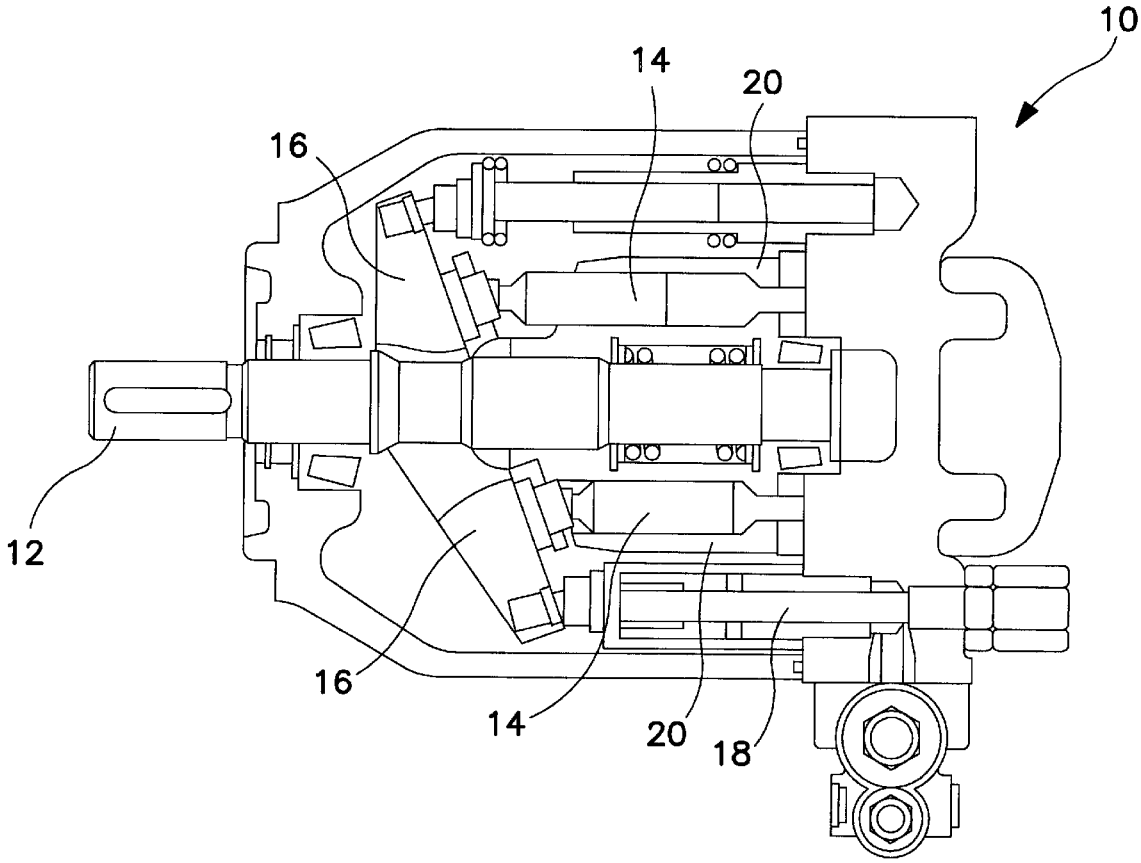
FIG. 1 PRIOR ART
FIG. 1 is a side elevational view, shown partly in cross-section and partly in plan view, of a traditional prior art hydraulic oil piston pump.

In the following detailed description of a first preferred embodiment and a second preferred embodiment of the present invention, reference is made to the accompanying drawings which, in conjunction with this detailed description, illustrate and describe a first preferred embodiment and a second preferred embodiment of a direct drive variable displacement pump in accordance with the present invention. Referring first to FIG. 1, which shows a side elevational view, shown partly in cross-section and partly in plan view, of a traditional prior art hydraulic oil piston pump, the traditional prior art hydraulic oil piston pump is generally identified by reference number 10. Traditional prior art hydraulic oil piston pumps generally provide variable displacement and are generally pressure, flow and power compensated. Such traditional prior art hydraulic oil piston pumps are generally of either an axial displacement or a radial displacement type. As seen in FIG. 1, traditional prior art hydraulic oil piston pump 10 is of the axial displacement type and converts rotational motion into axial motion. Rotating shaft 12 drives a series of pistons 14 and pistons 14 slide over swashplate 16, which is a non-rotating surface. Swashplate 16 pivots as necessary to increase or decrease the stroke length of pistons 14, thus increasing or decreasing the fluid flow. The pivoting angle of swashplate 16 is controlled by a control mechanism, such as hydraulic control pistons 18, that maintains relatively constant fluid flow, relatively constant fluid pressure and can also be horsepower limiting, if desired.

However, traditional prior art hydraulic oil piston pumps generally have practical fluid limitations at around 10,000 pounds per square inch and are generally used with fluids having lubricating properties, such as oil, which is not the case with other fluids, including water.

Figure 2C:
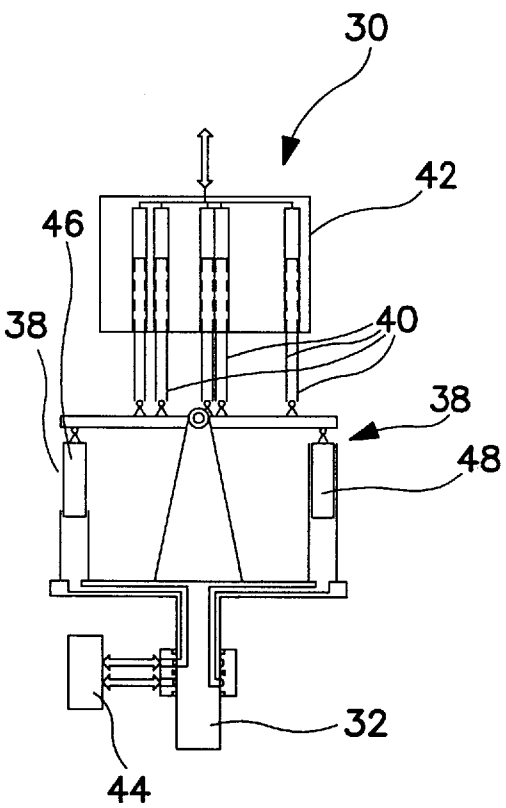
FIG. 2C is the same view as FIG. 2B, but showing the swashplate in a different tilt position.
Figure 2B:
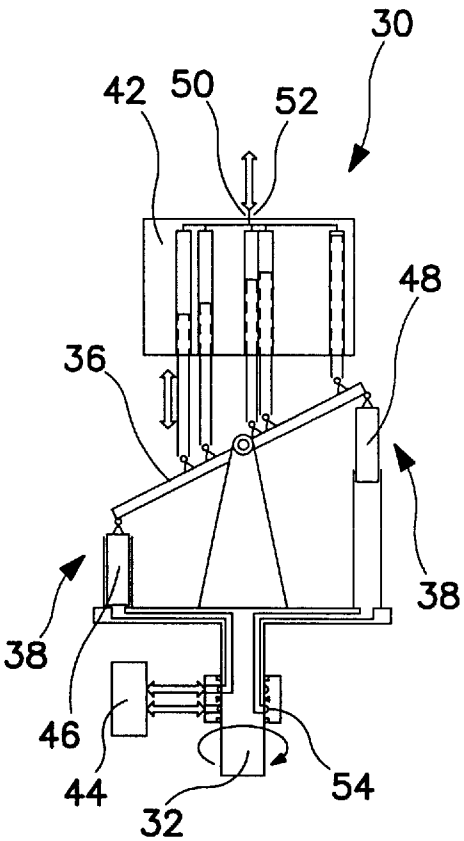
Figure 2A:
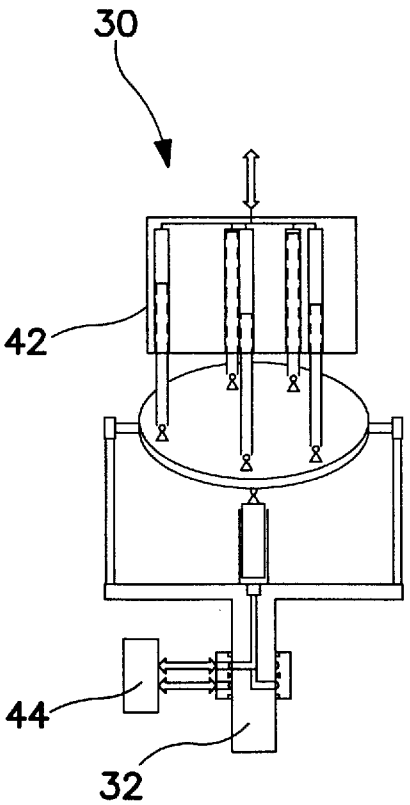
FIG. 2A is an elevational side view of FIG. 2B

Referring next to FIG. 2, which shows exploded elevational side views of a direct drive variable displacement pump in accordance with a first preferred embodiment of the present invention including FIGS. 2A, 2B and 2C wherein FIG. 2A is an elevational side view of FIG. 2B and FIG. 2C is the same view as FIG. 2B, but showing the swashplate in a different tilt position, the direct drive variable displacement pump in accordance with the present invention is generally identified by reference number 30. Direct drive variable displacement pump 30 uses many of the features of traditional prior art hydraulic oil piston pumps, such as traditional prior art hydraulic oil piston pump 10 shown in FIG. 1, but has significant innovative improvements which allows direct drive variable displacement pump 30 to achieve higher fluid pressures and to be capable of working with non-lubricating fluids, such as water.

As seen in FIGS. 1 and 2, both traditional prior art hydraulic oil piston pump 10 and direct drive variable displacement pump 30 provide variable displacement. Also, swashplate 16 pivots and changes the angle position in traditional prior art hydraulic oil piston pump 10 and swashplate 36 pivots and changes the angle position in direct drive variable displacement pump 30. In addition, swashplate 16 is capable of changing the stroke length of pistons 14 in traditional prior art hydraulic oil piston pump 10 and swashplate 36 changes the stroke length of plungers 40 in direct drive variable displacement pump 30. Rotation of rotating shaft 12 in traditional prior art hydraulic oil piston pump 10 is converted to axial movement and rotation of rotating shaft 12 in direct drive variable displacement pump 30 is converted to axial movement. However, while rotating shaft 12 rotates pistons 14 and piston housing 20 in traditional prior art hydraulic oil piston pump 10, plungers 40 and their respective plunger housings 42 do not rotate relative to rotating shaft 32 in direct drive variable displacement pump 30. Also, swashplate 16 does not rotate with rotating shaft 12 in traditional prior art hydraulic oil piston pump 10 while swashplate 36 does rotate with rotating shaft 32 in direct drive variable displacement pump 30. In addition, pistons 14 rotate with rotating shaft 12 in traditional prior art hydraulic oil piston pump 10 while plungers 40 in direct drive variable displacement pump 30 do not rotate relative to rotating shaft 32. Furthermore, hydraulic control pistons 18 change the angle of swashplate 18 and hydraulic control pistons 18 do not rotate relative to rotating shaft 12 in traditional prior art hydraulic oil piston pump 10 while hydraulic control pistons 38 change the angle of swashplate 36 and hydraulic control pistons 38 rotate with rotating shaft 32 in direct drive variable displacement pump 30.

As seen in FIG. 2, rotating shaft 32 and the supporting structure that holds de-stroke device 46 and on-stroke device 48 and the pivot points for swashplate 36 are preferably an integral part of or are solidly connected in direct drive variable displacement pump 30 such that the rotation and torque provided by rotating shaft 32 is transmitted by the pivot points to swashplate 36. The angle of swashplate 36 changes from a minimum angle, as shown in FIG. 2C, to a maximum angle, as shown in FIG. 2B, the angle position being adjusted by stationary stroke length controller 44. Swashplate angle control signals "A" and "B" are transmitted by rotating or swivel joint 54 to rotating shaft 32 and swashplate angle control signals "A" and "B" travel through rotating shaft 32 until they reach the respective de-stroke device 46 or on-stroke device 48. De-stroke device 46 and on-stroke device 48 are preferably linear actuators, mechanical, hydraulic or electric, which by extending and contracting cause swashplate 36 to change its angle as determined by stationary stroke length controller 44.

Plungers 40 and their respective plunger housings 42 do not rotate relative to rotating shaft 32 in direct drive variable displacement pump 30. Plungers 40 are forced to ride on swashplate 36 by a mechanism and, as rotating shaft 32, pivot point, and swashplate 36 rotate, plungers 40 are forced to move in an axial direction. As seen in FIGS. 2B and 2C, the extent of axial movement of plungers 40 increases or decreases as the angle of swashplate 36 changes, thus increasing or decreasing the displacement volume of fluid plungers 40 can pump.

While plungers 40 are moving in an inward direction, fluid is accepted into a cavity in the respective plunger housings 42 by fluid inlet mechanism 50. When fluid is accepted into the cavity in the respective plunger housings 42 by fluid inlet mechanism 50, fluid inlet mechanism 50 opens and fluid outlet mechanism 52 closes, and vice versa. Fluid inlet mechanism 50 and fluid outlet mechanism 52 can be any of a number of well known one-direction fluid flow mechanisms, such as check valves.

Stationary stroke length controller 44 is capable of operating to control the output in different ways, including controlling the fluid flow, controlling the fluid pressure or some combination thereof to achieve a number of types of controls, such as horsepower, etc. These same types of controls are presently available in traditional prior art hydraulic oil piston pumps and need not be further described here.

Figure 3:
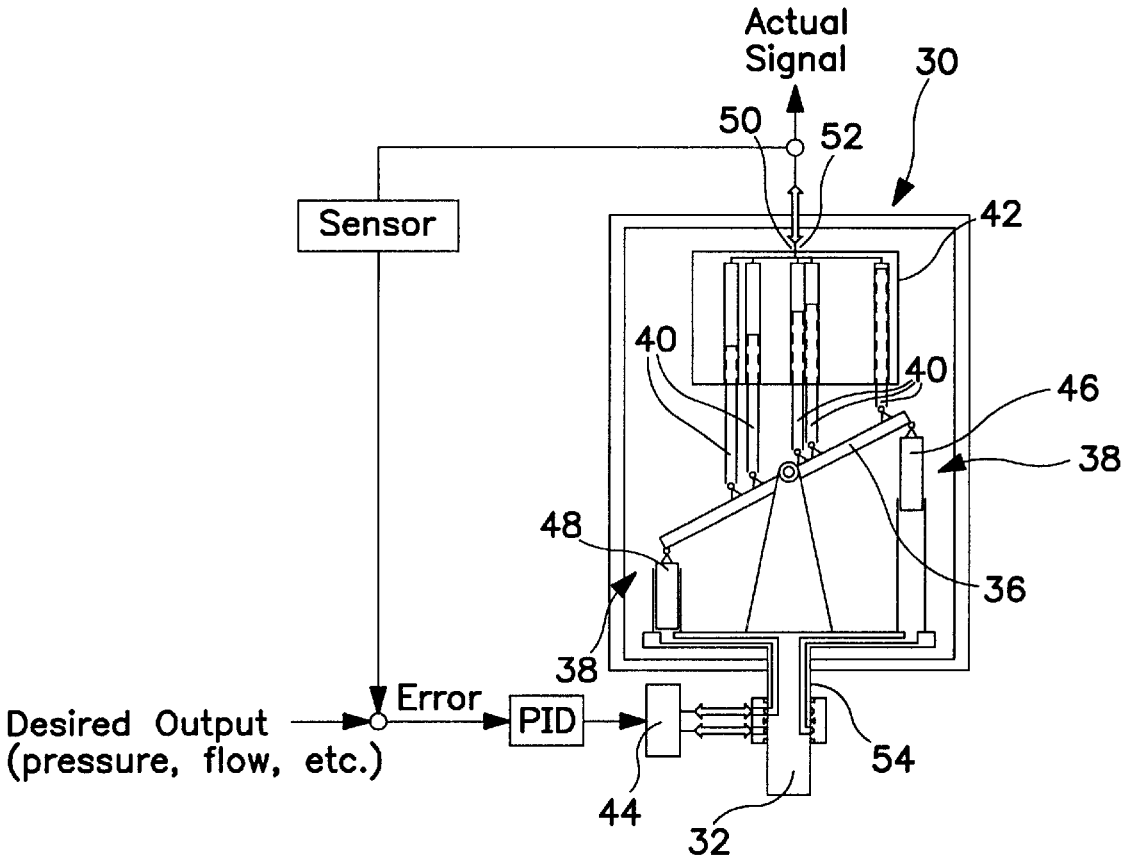
FIG. 3 is an exploded side elevational view of the direct drive variable displacement pump in accordance with a first preferred embodiment of the present invention shown in FIG. 2, showing a first preferred method of operating the stroke length controller using closed loop control.

In addition, operation of stationary stroke length controller 44 can be accomplished in several ways. Referring to FIG. 3, which shows an exploded side elevational view of the direct drive variable displacement pump in accordance with a first preferred embodiment of the present invention shown in FIG. 2, showing a first preferred method of operating the stroke length controller using closed loop control, a first preferred method of operating stationary stroke length controller 44 utilizes a closed loop control. In this first preferred method, the output signal from direct drive variable displacement pump 30 is compared to a preselected setting and stroke length controller 44 makes any necessary corrections to maintain the desired conditions.

Figure 4:
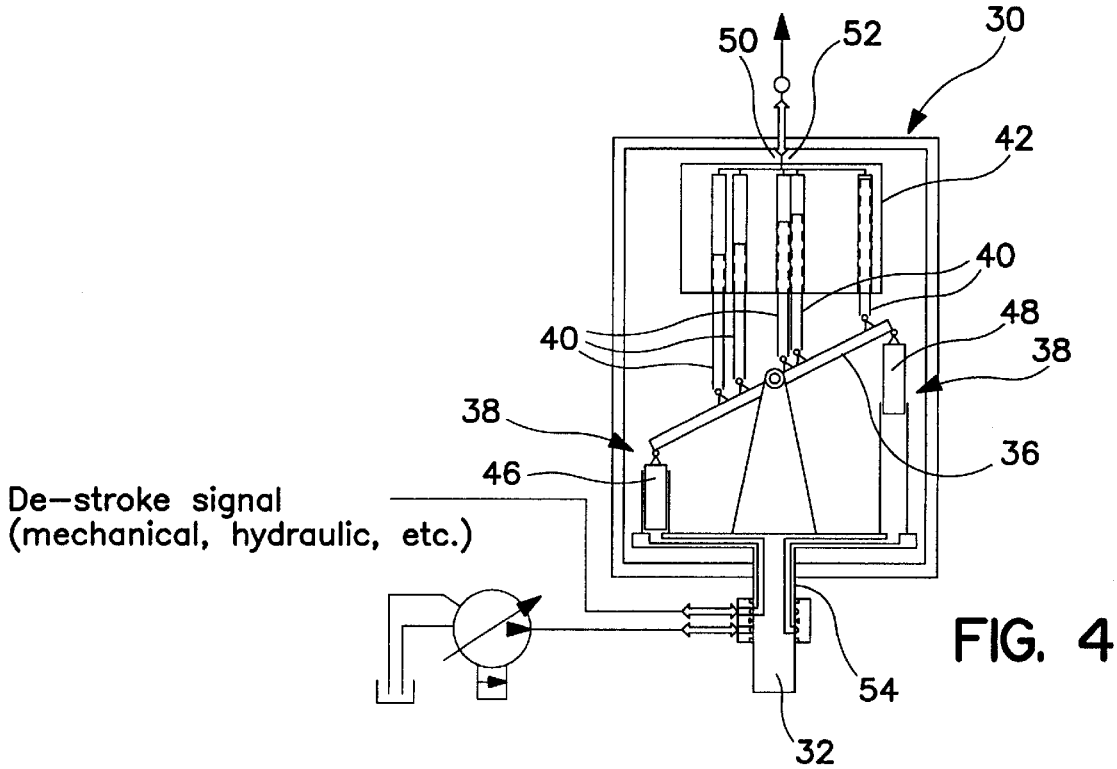
FIG. 4 is an exploded side elevational view of the direct drive variable displacement pump in accordance with a first preferred embodiment of the present invention shown in FIG. 2, showing a second preferred method of operating the stroke length controller using hydraulic open loop control constant pressure control.

Referring to FIG. 4, which shows an exploded side elevational view of the direct drive variable displacement pump in accordance with a first preferred embodiment of the present invention shown in FIG. 2, showing a second preferred method of operating the stroke length controller using hydraulic open loop control constant pressure control, a second preferred method of operating stationary stroke length controller 44 utilizes a hydraulic open loop control constant pressure control. In this second preferred method, a set-constant hydraulic pressure signal is sent by stationary stroke length controller 44 to de-stroke device 46, to on-stroke device 48, or to both de-stroke device 46 and on-stroke device 48, in this case shown as hydraulic pistons. The hydraulic pistons move swashplate 36 to a position that balances the load of plungers 40 and maintains this position. When the load on plungers 40 changes due to, for example, the need to increase, decrease or stop fluid flow, the force capability of the hydraulic pistons have not changed so the hydraulic pistons change the angle of swashplate 36 until reaching the new load balance position. This second preferred method of operating the stroke length controller using hydraulic open loop control constant pressure control has been found to be relatively simple, inexpensive, reliable and effective.

Figure 5:
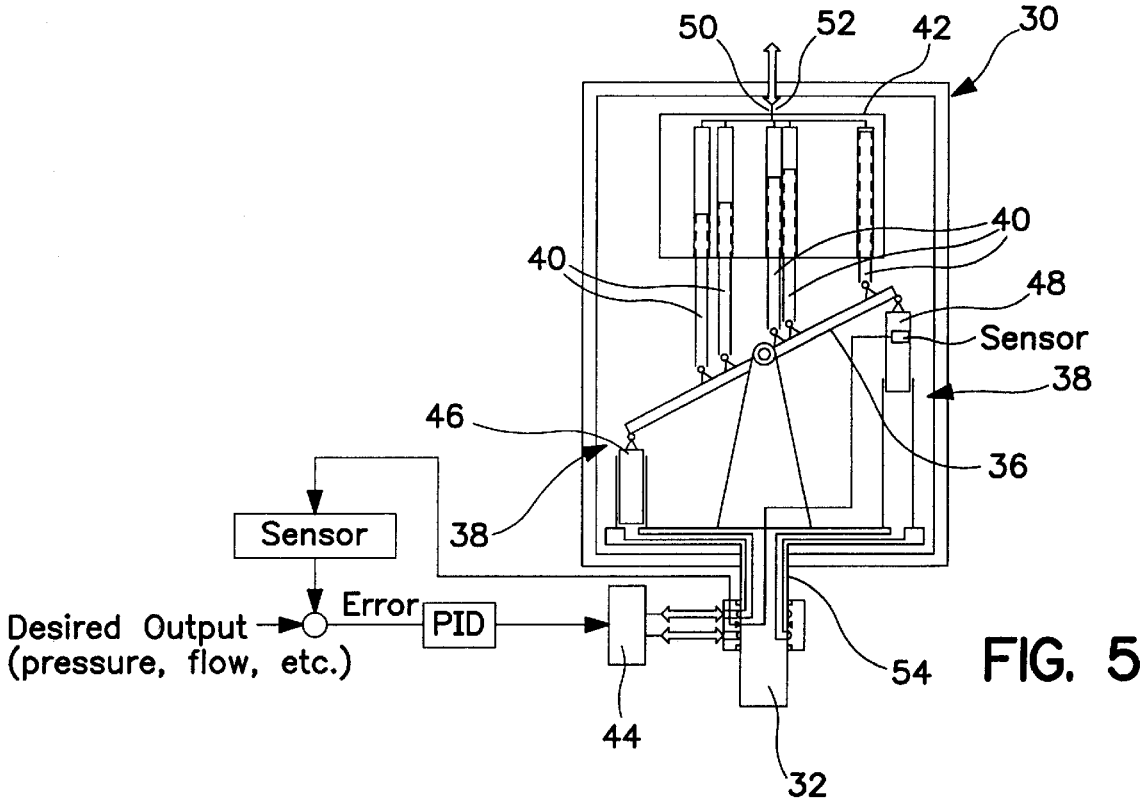
FIG. 5 is an exploded side elevational view of the direct drive variable displacement pump in accordance with a first preferred embodiment of the present invention shown in FIG. 2, showing a third preferred method of operating the stroke length controller using electric closed loop control constant pressure control.

Referring to FIG. 5, which shows an exploded side elevational view of the direct drive variable displacement pump in accordance with a first preferred embodiment of the present invention shown in FIG. 2, showing a third preferred method of operating the stroke length controller using electric closed loop control constant pressure control, a second preferred method of operating stationary stroke length controller 44 utilizes an electric closed loop control constant pressure control. In this third preferred method, a set-constant electric pressure signal is sent by stationary stroke length controller 44 to de-stroke device 46, to on-stroke device 48, or to both de-stroke device 46 and on-stroke device 48, in this case shown as electric linear actuators. The electric linear actuators move swashplate 36 to a position that balances the load of plungers 40 and maintains this position. In this case the load is detected by a load sensor and is compared to a preselected setting. When the load on plungers 40 changes due to, for example, the need to increase, decrease or stop fluid flow, the load sensor detects the change and stationary stroke length controller 44 causes the electric linear actuators to change the angle of swashplate 36 until reaching the new load balance position. This second preferred method of operating the stroke length controller using electric closed loop control constant pressure control has also been found to be relatively simple, inexpensive, reliable and effective.

The fourth and final preferred method of operating stationary stroke length controller 44 to be disclosed herein uses an electric closed loop constant flow control. In this fourth and final preferred method, a linear variable displacement transformer, or some other linear positioning device, is connected such that the relative position of plungers 40 is known. The signal from the linear variable displacement transformer, or some other positioning device, is then compared to a preselected reference setting and corrections are made if needed.

Figure 6C:
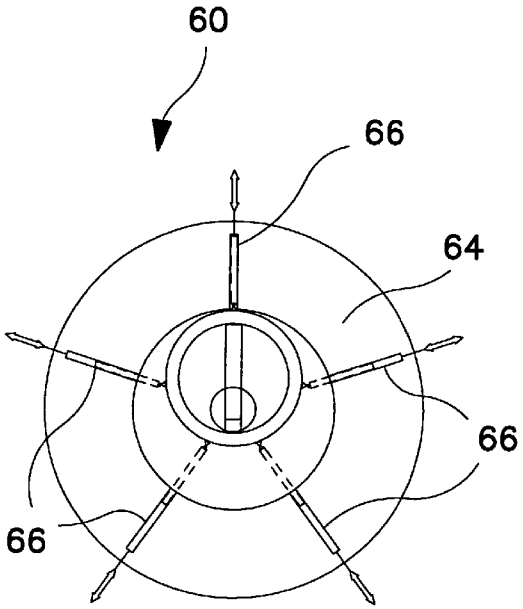
FIG. 6 includes an elevational schematic side view, a first top view showing plungers at zero displacement, and a second top view shown plungers at full displacement of a direct drive variable displacement pump in accordance with a second preferred embodiment of the present invention.
Figure 6B:
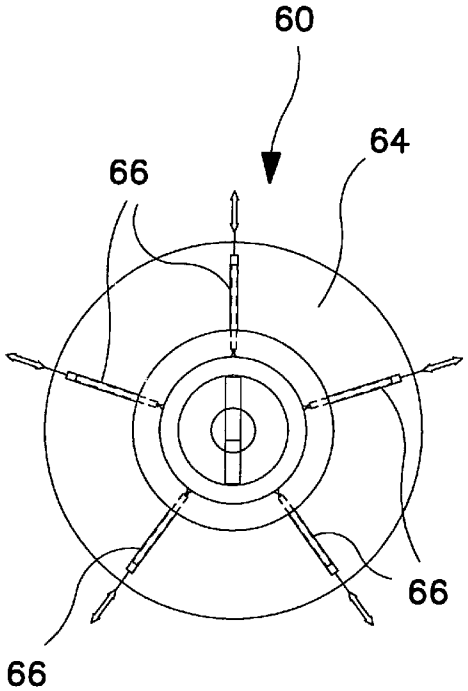
Figure 6A:
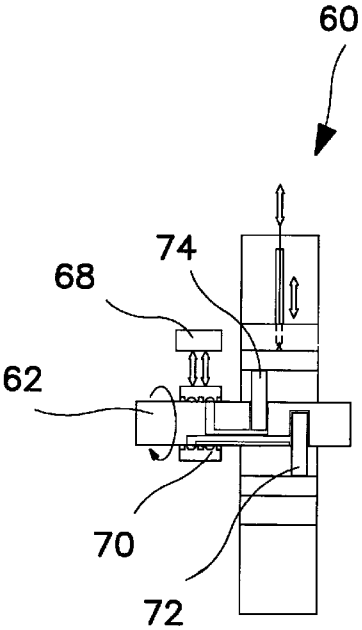

Referring to FIG. 6, an elevational schematic side view, a first top view showing plungers at zero displacement, and a second top view showing plungers at full displacement, of a direct drive variable displacement pump in accordance with a second preferred embodiment of the present invention is shown, the direct drive variable displacement pump in accordance with a second preferred embodiment is generally identified by reference number 60. Direct drive variable displacement pump 60 uses a radial plunger pump arrangement with variable fluid displacement, fluid pressure, fluid flow, etc. In direct drive variable displacement pump 60, rotating shaft 62 drives adjustable position plunger ring 64. Movement of adjustable plunger ring 64 is controlled such that it can change the extent of the stroke of plungers 66 by moving adjustable position plunger ring 64 from a position concentric to rotating shaft 62 to a position offset from rotating shaft 62. Control signals, such as, for example, electric, hydraulic, or mechanical control signals, are conveyed from fixed ring offset controller 68 to rotating shaft 62 by rotating or swivel joint 70, the control signal traveling through rotating shaft 62 into de-stroke device 72 and on-stroke device 74. The various alternative controls and operation of direct drive variable displacement pump 60 in accordance with a second preferred embodiment of the present invention are similar to those described above in conjunction with direct drive variable displacement pump 10 in accordance with a first preferred embodiment of the present invention.

Accordingly, although the present invention has been described above in detail, the same is by way of illustration and example only and is not to be taken as a limitation on the present invention. It is apparent to those having a level of ordinary skill in the relevant art that other variations and modifications in a direct drive variable displacement pump in accordance with the present invention, as described and shown herein, could be readily made using the teachings of the present invention. Accordingly, the scope and content of the present invention are to be defined only by the terms of the appended claims.

What is claimed is:

1. A direct drive variable displacement pump capable of converting rotation and torque from a rotating shaft into axial movement, said direct drive variable displacement pump comprising a rotating shaft, a swashplate and at least one plunger, said swashplate is capable of pivoting and changing the angle position and the stroke length of said at least one plunger, and at least one control piston which is capable of rotating with said rotating shaft and changing the angle of said swashplate.

2. The direct drive variable displacement pump in accordance with claim 1, wherein said swashplate is disposed on and rotates with the rotating shaft.

3. The direct drive variable displacement pump in accordance with claim 1, wherein each of said at least one plungers does not rotate with respect to the rotating shaft.

4. The direct drive variable displacement pump in accordance with claim 1, wherein said at least one control piston is a hydraulic control piston.

5. The direct drive variable displacement pump in accordance with claim 1, further including pivot points on which said swashplate is mounted, a de-stroke device and a on-stroke device, wherein the rotating shaft and the supporting structure that holds said de-stroke device and said on-stroke device and the pivot points for said swashplate are an integral part of said direct drive variable displacement pump such that the rotation and torque of the rotating shaft are transmitted by the pivot points to said swashplate.

6. The direct drive variable displacement pump in accordance with claim 1, further including pivot points on which said swashplate is mounted, a de-stroke device and a on-stroke device, wherein the rotating shaft and the supporting structure that holds said de-stroke device and said on-stroke device and the pivot points for said swashplate are solidly connected in said direct drive variable displacement pump such that the rotation and torque of the rotating shaft are transmitted by the pivot points to said swashplate.

7. The direct drive variable displacement pump in accordance with claim 6, wherein said de-stroke device and said on-stroke device are linear actuators.

8. The direct drive variable displacement pump in accordance with claim 6, wherein said de-stroke device and said on-stroke device are mechanical linear actuators.

9. The direct drive variable displacement pump in accordance with claim 6, wherein said de-stroke device and said on-stroke device are hydraulic linear actuators.

10. The direct drive variable displacement pump in accordance with claim 6, wherein said de-stroke device and said on-stroke device are electric linear actuators.

11. The direct drive variable displacement pump in accordance with claim 1, further including a stationary stroke length controller that controls the angle position of said swashplate.

12. The direct drive variable displacement pump in accordance with claim 11, wherein said stationary stroke length controller controls the angle position of said swashplate using closed loop control.

13. The direct drive variable displacement pump in accordance with claim 11, wherein said stationary stroke length controller controls the angle position of said swashplate using hydraulic open loop control constant pressure control.

14. The direct drive variable displacement pump in accordance with claim 13, further including a de-stroke device and a on-stroke device and said de-stroke device and said on-stroke device are hydraulic pistons.

15. The direct drive variable displacement pump in accordance with claim 11, wherein said stationary stroke length controller controls the angle position of said swashplate using electric closed loop control constant pressure control.

16. The direct drive variable displacement pump in accordance with claim 15, further including a de-stroke device and a on-stroke device and said de-stroke device and said on-stroke device are electric linear actuators.

17. The direct drive variable displacement pump in accordance with claim 11, wherein said stationary stroke length controller controls the angle position of said swashplate using electric closed loop constant flow control.

18. The direct drive variable displacement pump in accordance with claim 1, wherein each of said at least one plungers move within a respective plunger housing having a cavity in fluid communication with a fluid inlet mechanism and a fluid outlet mechanism, wherein as each of said at least one plungers are moving into said housing, fluid is accepted into said cavity by said fluid inlet mechanism and said fluid outlet mechanism closes.

19. The direct drive variable displacement pump in accordance with claim 1, wherein said direct drive variable displacement pump is an axial displacement type pump.

20. The direct drive variable displacement pump in accordance with claim 1, wherein said direct drive variable displacement pump is a radial displacement type pump.

21. A direct drive variable displacement pump capable of converting rotation and torque from a rotating shaft into axial movement, said direct drive variable displacement pump comprising a rotating shaft, a swashplate, pivot points on which said swashplate is mounted, and at least one plunger, said swashplate is capable of pivoting and changing the angle position and the stroke length of said at least one plunger, at least one control piston which is capable of rotating with said rotating shaft and changing the angle of said swashplate, pivot points on which said swashplate is mounted, and a de-stroke device and a on-stroke device, wherein the rotating shaft and the supporting structure that holds said de-stroke device and said on-stroke device and the pivot points for said swashplate are an integral part of said direct drive variable displacement pump such that the rotation and torque of the rotating shaft are transmitted by the pivot points to said swashplate.

* * * * *

UNITED STATES PATENT AND TRADEMARK OFFICE

CERTIFICATE OF CORRECTION

PATENT NO. : 6,443,705 B1
DATED : September 3, 2002
INVENTOR(S) : Jose P. Munoz

It is certified that error appears in the above-identified patent and that said Letters Patent is hereby corrected as shown below:

Title page,
Item [56], References Cited, OTHER PUBLICATIONS, please add:
-- Paper - The Development of New Waterjet Pumps, 10th American Waterjet Conference, August 14-17, 1999, Houston, Texas, Gene G. Yie, Jetec Company - 10 pages --

Signed and Sealed this

Twenty-sixth Day of November, 2002

*Attest:*

*Attesting Officer*

JAMES E. ROGAN
*Director of the United States Patent and Trademark Office*